US006554678B2

(12) United States Patent
Lavender

(10) Patent No.: US 6,554,678 B2
(45) Date of Patent: Apr. 29, 2003

(54) SCULPTURAL TOY

(75) Inventor: Michael R. Lavender, Chicago, IL (US)

(73) Assignee: Emerging Playthings, Inc., Chicago, IL (US)

( * ) Notice: Subject to any disclaimer, the term of this patent is extended or adjusted under 35 U.S.C. 154(b) by 0 days.

(21) Appl. No.: 10/096,675

(22) Filed: Mar. 13, 2002

(65) Prior Publication Data

US 2002/0115374 A1 Aug. 22, 2002

Related U.S. Application Data

(63) Continuation of application No. 09/575,388, filed on May 22, 2000, now abandoned.

(51) Int. Cl.[7] ..... A63H 33/08
(52) U.S. Cl. ..... 446/125; 446/124
(58) Field of Search ..... 446/85, 105, 120, 446/121, 124, 125

(56) References Cited

U.S. PATENT DOCUMENTS 740,188 A * 9/1903 Coster ..... 446/114
3,670,351 A * 6/1972 Drury ..... 14/19
3,882,630 A * 5/1975 Bianco ..... 446/106
4,041,670 A * 8/1977 Kaplan ..... 446/114
4,385,459 A * 5/1983 McGrath et al. ..... 40/124
4,461,116 A * 7/1984 Bach ..... 403/280
5,199,919 A * 4/1993 Glickman ..... 446/120
5,378,185 A * 1/1995 Ban ..... 446/120
5,391,103 A * 2/1995 Mak ..... 446/124
5,685,120 A * 11/1997 Sihra ..... 273/156
5,853,314 A * 12/1998 Bora ..... 446/102
6,116,981 A * 9/2000 Zheng ..... 446/106

* cited by examiner

*Primary Examiner*—Jacob K. Ackun
*Assistant Examiner*—Faye Francis
(74) *Attorney, Agent, or Firm*—Knechtel, Demeur & Samlan

(57) ABSTRACT

A sculptural toy or building block designed and adapted to be joined to other identical sculptural toys or building blocks to create infinite figures and shapes. The sculptural toy or building block is an elongated member that is comprised of five portions: two legs, two feet, and an opening. Each leg is provided with a foot at its distal end and is separated from the other leg by the opening located in the center of the elongated toy member. The legs, feet, and opening are linearly oriented in the same plane with each formed into rectangular or square configurations. The leg configurations also include slots that extend along the entire length of the leg. The feet of one toy member can be received at various angles along the slots in the legs of another toy member. Also, the leg of one toy member can be slidably received into the opening of another toy member.

4 Claims, 4 Drawing Sheets

SCULPTURAL TOY

RELATED PATENT APPLICATION

This application is a continuation of U.S. patent application, Ser. No. 09/575,388 filed on May 22, 2002, now abandoned.

FIELD OF THE INVENTION

The present invention relates to sculptural toys and, more particularly, to a symmetrical toy member or building block that is designed to be slidably received or frictionally engaged with other toy members or building blocks to build or design an infinite number of artistic creations.

DESCRIPTION OF THE PRIOR ART

Sculptural toys or building blocks have provided a great source of entertainment to children and adults. Typically, the sculptural toys or building blocks are formed of a basic geometric shape such as a square or rectangular member that is provided with a number of male ends or connecting studs for attachment to a number of complementary female ends to interconnect one sculptural toy or building block to another.

An example of a typical sculptural toy or building block is illustrated in U.S. Pat. No. 3,374,917 to Troy entitled "Interlocking Structural Elements". This patent discloses a block that consists of four sides and two ends. The four sides are provided with an indented female member and the two ends are provided with a raised male member. The raised male member is then inserted into the indented female member of another block to join the two blocks together. In this manner, a plurality of blocks are connected to form numerous designs and configurations.

Other building blocks or toy shaped members that use similar means to join or snap the blocks or toy shaped members together are disclosed in U.S. Pat. No. 4,306,373 to Chatani entitled "Interconnecting Toy Block Arrangement"; U.S. Pat. No. 4,305,221 to Chatani entitled "Block Of Members Having Interior Interlock Means"; U.S. Pat. No. 3,566,531 to Hasel entitled "Mating Blocks Having Beaded Studs And Resilient Sidewalls"; U.S. Pat. No. 5,518,434 to Ziegler entitled "Snap Fit And Twistable Toy Construction Modules"; U.S. Pat. No. 2,577,702 to Swart entitled "Toy Construction Element"; U.S. Pat. No. 2,063,895 to Mack entitled "Joint For Structural Toys"; and Canadian Patent 595,883 to Hansen entitled "Model Box of Bricks".

The above identified sculptural toys or building blocks have several inherent shortcomings. First, the designs are limited to joining the blocks together by male members being received in frictional engagement by complementary female members or by a member of one building block being snapped to a complementary member of another building block. The designs, however, are devoid of a complete opening in the blocks to receive a portion of another block through that opening. Second, as the blocks are joined together by the frictional engagement of male and female members, the blocks do not enable one block to be interlocked to another block at any angle other than ninety degrees to each other. Third, the blocks are only capable of being joined at the ends or at another designated portion of the block. As a result, the blocks are limited in their use and the artistic expressions created by the joining of one block to another. Fourth, as the blocks are only capable of being joined at the ends or at another designated portion of the block, the blocks do not permit one block to be frictionally engaged by another block and then slidably moved into a different position within the same receiving block. Fifth, due to the design of the male and female members to join one block to another, the number of blocks that can be joined to any one single block is limited.

Thus, there is a need and there has never been disclosed a sculptural toy or building block that can be received by another building block in the unique manner of the present invention. Applicant's building block can be slidably received in an opening in a second building block or can be frictionally received in a slot in the second building block which also permits repositioning of the first building block anywhere along the slot in the second building block.

OBJECTS OF THE INVENTION

It is the primary object of the present invention to provide a symmetric toy member with a plurality of different members to be received by another toy member. A related object of the present invention is to provide a toy member with a plurality of female receiving members to receive another toy member.

Another object of the present invention is to provide a toy member that is capable of slidably receiving a portion of another toy member. A related object of the present invention is to provide a toy member with a means to restrict the extent of movement of one toy member as it is slidably received by another toy member.

Yet another object of the present invention is to provide a toy member that frictionally engages another toy member. A related object is to provide a toy member that can frictionally engage another toy member at various angles.

Still another related object of the present invention is to provide a toy member that is capable of providing an infinite number of artistic creations that stimulates artistic expression.

Another object of the invention is to provide a toy member that is easy to use, capable of withstanding continuous use, and safe for the user. A related object is to provide a toy member that is appropriately dimensioned to be safe for use and enjoyment by children.

Other objects of the present invention will become more apparent to persons having ordinary skill in the art to which the present invention pertains from the following description taken in conjunction with the accompanying drawings.

SUMMARY OF THE INVENTION

The present invention is an elongated toy member that is comprised of five portions: two legs, two feet, and an opening. Each leg is provided with a foot at its distal end and is separated from the other leg by the opening located in the center of the elongated toy member. The legs, feet, and opening are linearly oriented in the same plane with each formed into rectangular or square configurations. The leg configurations also include slots that extend along the entire length of the leg.

The toy members are adapted to be joined to other identical toy members to create infinite figures and shapes. The feet of one toy member can be received at various angles along the slots in the legs of another toy member. Also, the leg of one toy member can be slidably received into the opening of another toy member.

BRIEF DESCRIPTION OF THE DRAWINGS

The Description of the Preferred Embodiment will be better understood with reference to the following figures.

DETAILED DESCRIPTION OF THE PREFERRED EMBODIMENT

Figure 1:
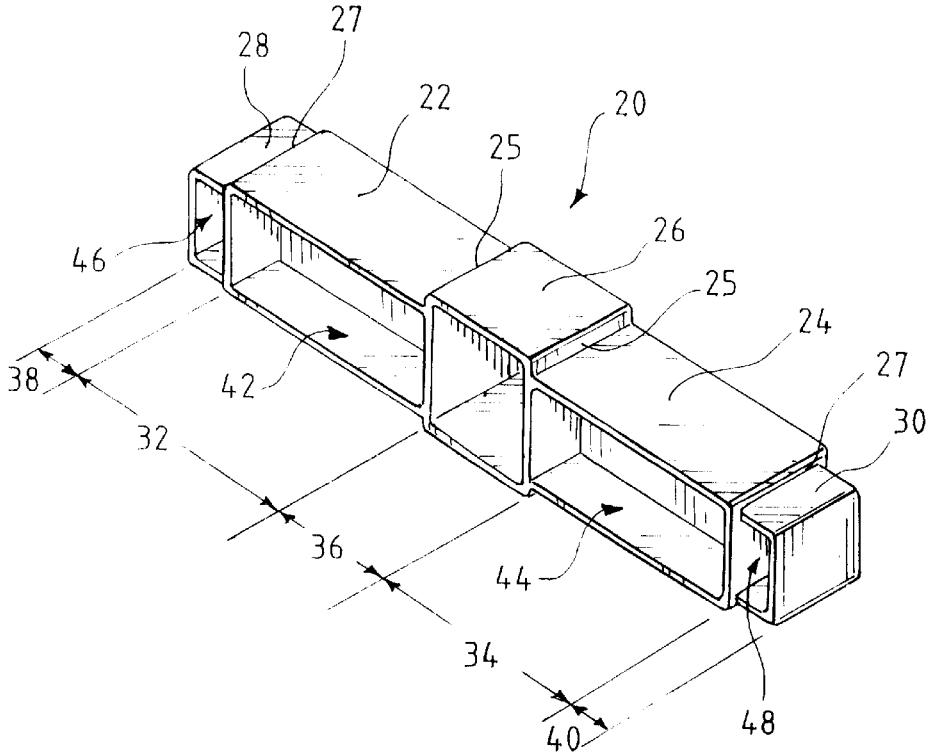
FIG. 1 is a front perspective view of the inventive construction element.

Turning first to FIG. 1, there is illustrated a sculptural toy or element 20 as depicted from a front perspective view. The sculptural toy 20 is comprised of legs 22 and 24 separated by an opening 26. Each leg 22, 24 has an interior end 25 and a distal end 27. Preferably, the opening 26 is located in the center of the sculptural toy 20 and is completely hollow through the sculptural toy 20. The legs 22 and 24 each have a foot 28 and 30 located opposite the opening 26 and at the distal end 27 of the legs 22 and 24. The legs 22 and 24, opening 26, and feet 28 and 30 form an elongated linear member along a central axis lying in a horizontal plane of the sculptural toy 20. The legs 22 and 24 have a leg length 32 and 34. Preferably, the leg length 32 is approximately equal to the leg length 34. In an alternate embodiment, the leg length 32 may be larger or smaller than the leg length 34. The opening 26 has an opening length 36. In the preferred embodiment, the opening 26 is approximately one-half of the length of the leg length 32 and the leg length 34. The feet 28 and 30 protrude out from the distal end 27 and have a foot length 38 and 40, respectively. In the preferred embodiment, the foot length 38 is approximately equal to the foot length 40. Alternatively, it is contemplated that the foot length 38 or the foot length 40 may be larger or smaller as discussed in further detail later in the specification.

The legs 22 and 24 each have slots 42 and 44. The slots 42 and 44 receive in frictional engagement the foot 28 or 30 of another sculptural toy 20. In the preferred embodiment, slots 42 and 44 extend the entire leg length 32 and 34 of legs 22 and 24, respectively. The advantage of the slots 42 and 44 extending the entire length of leg length 32 and 34 is that the slots 42 and 44 enable additional sculptural toys 20 to be attached within the slots 42 and 44. The slots 42 and 44 further allow the second or subsequent sculptural toy 20 to be inserted or slid anywhere along the length of the sltos 42 and 44. Alternatively, the slot 42 may be larger or smaller than slot 44 and slot 44 provided that at least one foot 28 or 30 is likewise made larger or smaller to frictionally engage the larger or smaller slot 42 or 44. The feet 28 and 30 each have ports 46 and 48.

Preferably, the legs 22 and 24, the opening 26, and the feet 28 and 30 are injection molded from plastic resins to form the sculptural toy 20. The injection molded method is the most efficient and least expensive means to manufacture the sculptural toy 20. Alternatively, the sculptural toy 20 may be made from different types of wood by saw and router cutting machinery or die cast from metal. An advantage of manufacturing the sculptural toy 20 from metal is that a mixture of metals may be used to create different color patterns and provide a unique appearance for each sculptural toy 20.

Figure 2:
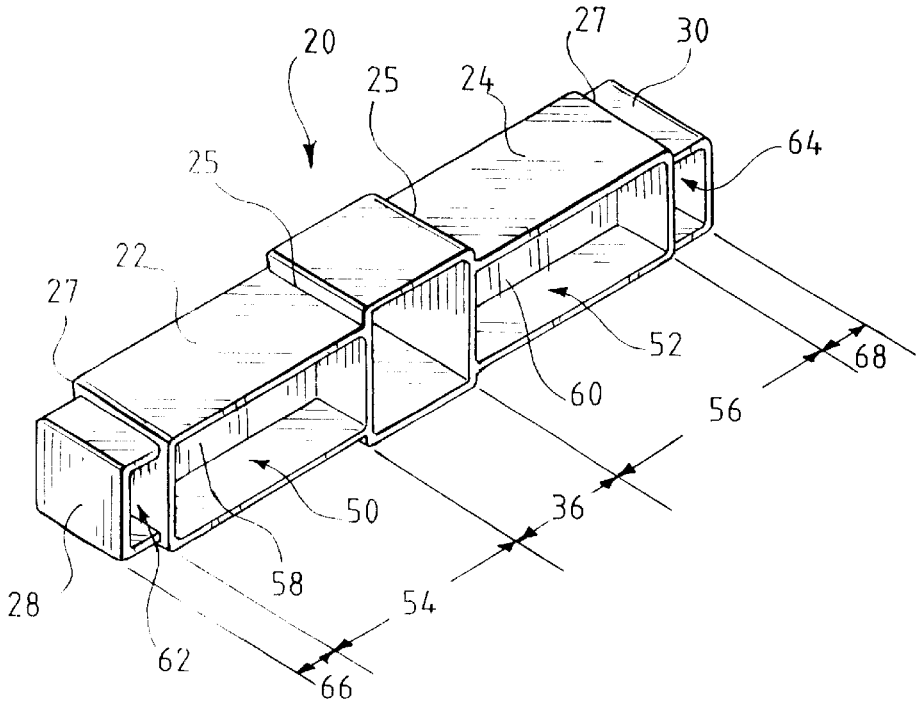
FIG. 2 is a rear perspective view of the inventive device.

Turning to FIG. 2, the back of the sculptural toy 20 is depicted. In the preferred embodiment, the sculptural toy 20 is symmetrical both vertically and horizontally about a lengthwise central axis through the sculptural toy 20 such that the front of the sculptural toy 20 of FIG. 1 is approximately identical to the back of the sculptural toy 20 of FIG. 2. In this manner, the legs 22 and 24 each have slots 50 and 52. Slots 50 and 52 each have a slot length 54 and 56. In the preferred embodiment, the slot length 52 and 54 is approximately equal to the length of slots 42 and 44, respectively. Alternatively, the slot length 54 may be larger or smaller than slot length 56 and may be larger or smaller than the lengths of the slots 42 or 44. Legs 22 and 24 have a central dividing wall 58 and 60 which separate slot 42 from slot 52 and slot 44 from slot 50.

The feet 28 and 30 each have ports 62 and 64. In the preferred embodiment, the ports 62 and 64 are approximately equal to the ports 48 and 46. The ports 62 and 64 have a port length 66 and 68. Preferably, the port length 66 of port 62 is approximately equal to the port length 68 of port 64 and the port length 40 of the port 48. The port length 68 is also preferably equal to the port length 38 of the port 46.

Figure 3:
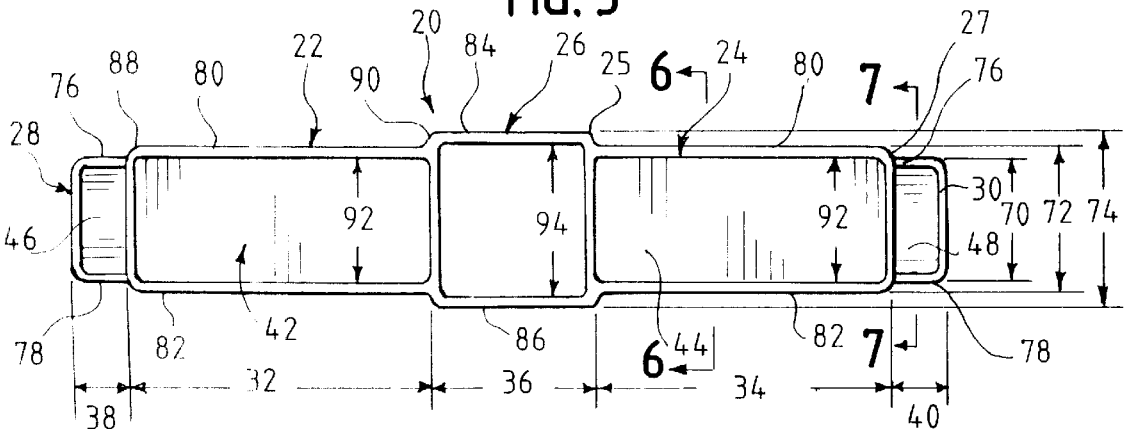
FIG. 3 is a front elevational view of the inventive device depicting the portions of the device for receiving another device.

The front of the sculptural toy 20 is more clearly illustrated in FIG. 3. The sculptural toy 20 has three heights: a foot height 70, a leg height 72, and an opening height 74. The feet 28 and 30 have a foot top surface 76 and a foot bottom surface 78 which are separated by the foot height 70. The legs 22 and 24 have a leg top surface 80 and a leg bottom surface 82 which are separated by the leg height 72. The opening has a top surface 84 and a bottom surface 86 which are separated by the opening height 74. In the preferred embodiment, the feet 28 and 30 have approximately the same foot height 70 and the legs 22 and 24 have approximately the same leg height 72. Also, in the preferred embodiment, the foot height 70 is smaller than the leg height 72 and the leg height 72 is smaller than the opening height 74.

At the distal end 27 where the feet 28 and 30 are formed with the legs 22 and 24, a heel 88 is created. The heel 88 has a height which is approximately equal to the difference between the foot height 70 and the leg height 72. At the interior end 25 of the legs 22 and 24 where the legs 22 and 24 connect to the opening 26, there is formed a shoulder 90. The shoulder 90 has a height which is approximately equal to the difference between the leg height 72 and the opening height 74.

In the preferred embodiment, the feet 28 and 30 are rectangular in shape with the foot length 38 and 40 being smaller than the foot height 70; the legs 22 and 24 are rectangular in shape with the leg length 32 and 34 being larger than the leg height 72; and the opening 26 is square in shape with the opening length 36 being approximately equal to the opening height 74.

The slots 42 and 44 of the legs 22 and 24 have a slot height 92. In the preferred embodiment, the slot height 92 is approximately equal to the foot height 70 so that the slot frictionally engages the feet 28 or 30 to another sculptural toy 20 as illustrated and described in further detail in FIGS. 9 and 10.

Figure 4:
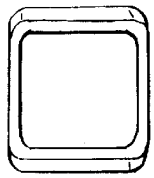
FIG. 4 is an end elevational view of the inventive device.

The opening 26 has an interior height 94. The interior height 94 is approximately equal to the leg height 72 such that the leg 22 or 24 of one sculptural toy 20 may be slidably received into the opening 26 of another sculptural toy 20 as illustrated and described in further detail in FIG. 8. The differences of each of the heights between the feet 28 and 30, the legs 22 and 24, and the opening 26 are further illustrated in FIG. 4. Preferably, the differences between each of the heights is approximately equal. Alternatively, the differences in height could be larger or smaller provided that the frictional engagement and slidable relationship between two sculptural toys 20 remain the same.

Figure 5:
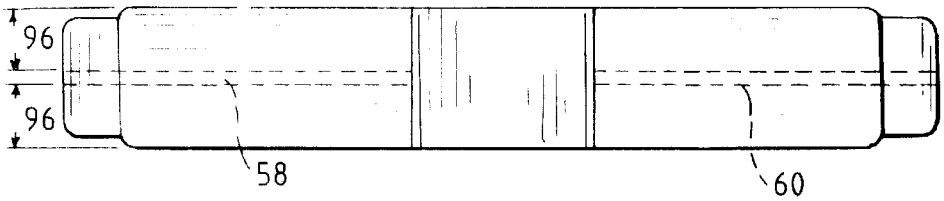
FIG. 5 is a top elevational view of the inventive device.
Figure 6:
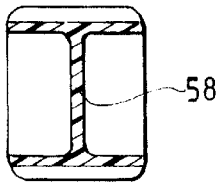
FIG. 6 is a cross sectional view taken along line 6—6 of FIG. 5.
Figure 7:
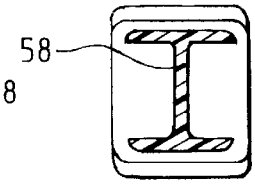
FIG. 7 is a cross sectional view taken along line 7—7 of FIG. 5.

In FIGS. 5–7, the central dividing wall 58 and 60 is depicted. In the preferred embodiment, the central dividing wall 58 extends the entire slot height 92 within legs 22 and 24. The legs 22 and 24, with the inclusion of the central dividing wall 58 and 60, form an I beam in cross section. The central dividing wall 58 equally separates the slot 42 from the slot 52 and the central dividing wall 60 equally separates the slot 44 from the slot 50 such that slots 42 and 52 and slots 44 and 50 each have an equal slot depth 96. Preferably, the slot depth 96 is approximately equal to the foot length 38 and 40 such that the foot 28 or foot 30 of one sculptural toy 20 may be frictionally engaged with the any one of slots 42, 44, 50, or 52 of another sculptural toy 20 as illustrated and described in further detail in FIG. 9.

Figure 8:
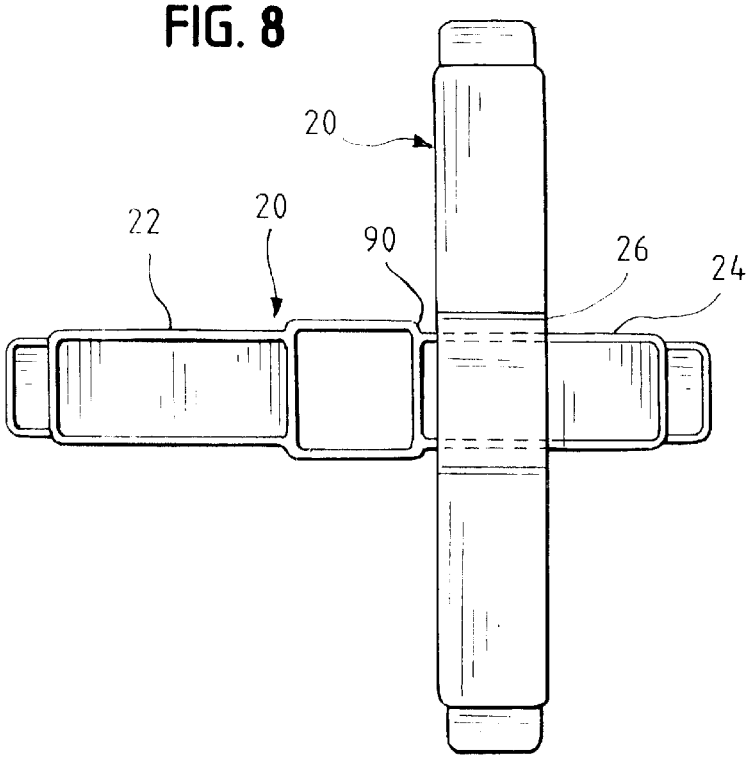
FIG. 8 is a top plan view illustrating the construction element slidably receiving another construction element through the opening in the inventive device.

The sculptural toy 20 permits the leg 22 or 24 of one sculptural toy 20 to be slidably received into the opening 26 of another sculptural toy 20. For example, as illustrated in FIG. 8, the leg 24 of a first sculptural toy 20, positioned with the front of the sculptural toy 20 facing the user, is inserted into and through the opening 26 of a second sculptural toy 20. The shoulder 90 of the opening 26 of the first sculptural toy 20 engages the front of the second sculptural toy 20 to act as a stopping means and prevent the first sculptural toy 20 from being further received into the opening 26 of the second sculptural toy 20. Alternatively, the first sculptural toy 20 may be slidably received into the opening 26 of the second sculptural toy 20 in three other positions with the top, bottom, or back side facing the user. Preferably, the leg 22 or 24 has a leg length 32 or 34 (FIG. 1) that is approximately two times the opening length 36 (FIG. 1). Such a length permits the leg 22 or 24 of the first sculptural toy 20 to be slidably received into the opening 26 of a second and third sculptural toy 20 simultaneously (not illustrated). In this manner, one sculptural toy 20 may be connected to two sculptural toys 20 by the leg 22 being slidably received into the opening 26 of the second and third sculptural toys 20. The one sculptural toy 20 may also be connected to two more sculptural toys 20 by the leg 24 being slidably received into the opening 26 of a fourth and fifth sculptural toys 20.

Figure 10:
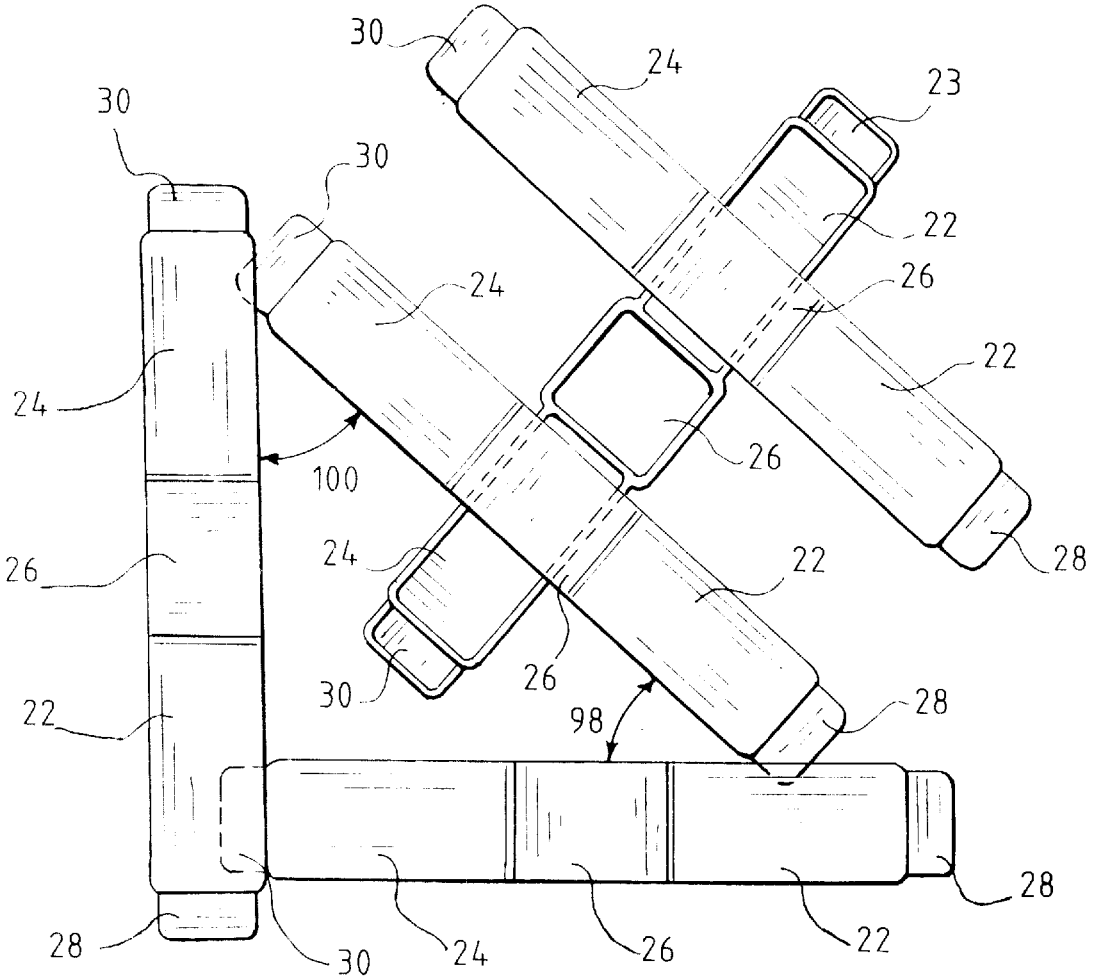
FIG. 10 is a top plan view depicting an artistic expression of the inventive device as interlocked with several other construction elements at differing angles to illustrate an alternate embodiment.

FIG. 10 illustrates the simultaneous connection of several sculptural toys 20 to the legs 22 and 24 of other sculptural toys 20. In this manner, infinite configurations can be created to join the sculptural toys 20. Alternatively, the leg length 34 of leg 22 or 24 may be longer to permit the connection to more than two sculptural toys 20.

Figure 9:
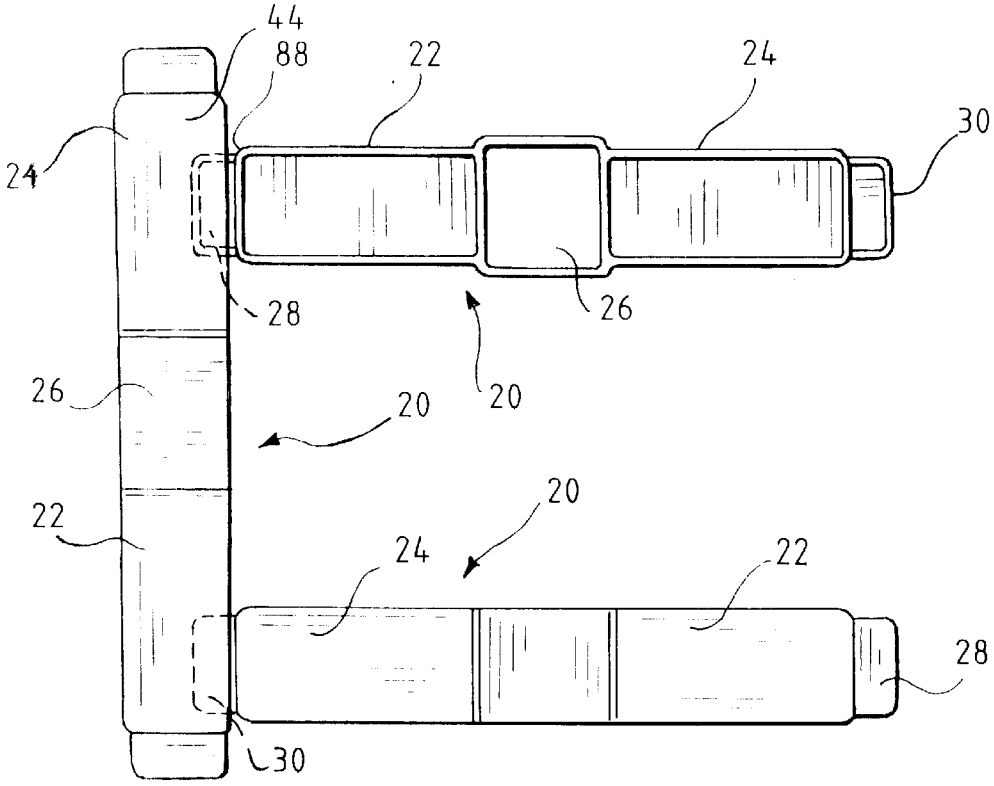
FIG. 9 is a top plan view illustrating the construction element frictionally receiving two other construction elements.

The sculptural toy 20 also permits the foot 28 or 30 of one sculptural toy 20, positioned with the front of the sculptural toy 20 facing the user, to be frictionally engaged anywhere within the slots 42, 44, 50, or 52 of legs 22 or 24 of another sculptural toy 20. For example, as illustrated in FIG. 9, the foot 28 of leg 22 of a first sculptural toy 20 is frictionally engaged with the slot 44 of leg 24 of a second sculptural toy 20. The entire foot length 38 of the foot 28 of the first sculptural toy 20 is received into the slot 44 of the second sculptural toy 20 with the heel 88 of the first sculptural toy 20 acting as a stop means to prevent the foot 28 from being inserted any further into slot 44 of the second sculptural toy 20. The central dividing wall (FIGS. 5–7) also acts as additional stopping means to prevent the first sculptural toy 20 from being received any further into the slot 44 of the second sculptural toy 20. In the preferred embodiment, the foot height 70 is approximately equal to the slot height 92 of slot 44 (FIG. 3) such that foot top surface 76 and foot bottom surface 78 apply equal and opposite forces upon the interior of the leg top surface 80 and the leg bottom surface 82, respectively. This provides a snug yet releasable frictional engagement of the first sculptural toy 20 to the second sculptural toy 20. Alternatively, the first sculptural toy 20 may be frictionally received into the slot 44 of the second sculptural toy 20 in three other positions with the top side facing the user as illustrated in the leg 22 also illustrated in FIG. 9, the bottom side facing the user, or back side facing the user.

The sculptural toys 20 are depicted in FIG. 9 to be frictionally engaged to other sculptural toys 20 at a ninety degree angle to each other. As illustrated in FIG. 10, the sculptural toy 20 may also be frictionally engaged to other sculptural toys 20 at engagement angles 98 and 100. The sculptural toy 20 is capable of being frictionally engaged with a second and third sculptural toy 20 at the engagement angle 98 and 100. FIG. 10 illustrates the engagement angle 98 and 100 to be approximately equal. Alternatively, the engagement angles of 98 and 100 may be any other angle between approximately thirty (30) degrees and one hundred and fifty (150) degrees.

Thus, there has been provided a unique sculptural toy that is capable of being slidably received and frictionally engaged with a plurality of other sculptural toys for a user to build or design an infinite number of artistic creations. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A toy construction element, comprising:

an elongated member having a pair of opposed legs, each leg having an interior end and a distal end;

a channel extending from the interior end to the distal end of each leg;

a foot at the distal end of each of the legs, and a central dividing wall in each of the legs separating the channel of each leg into a front section and a back section, the front section and the back section each dimensioned to receive in frictional engagement a foot of a second, identical elongated member.

2. The toy construction element of claim 1 and further comprising an opening centrally disposed between and connected to the interior end of each of the legs, the legs maintaining a linear relationship with each other.

3. The toy construction element of claim 2 wherein the opening has a length and a height dimensioned to receive in sliding relationship an opposed leg of the second elongated member.

4. A toy construction element, comprising:

an elongated member having a first leg and a second leg, the first leg and the second leg each having opposed proximal and distal ends, a top, a bottom, and a central dividing wall in each of the first leg and the second leg separating the first leg and the second leg into a front and a back;

a leg slot located in each of the front and the back of the first and the second legs, the leg slot in the front of the first and the second leg separated from the leg slot in the back of the first and the second leg by the central dividing wall, the leg slot extending from the proximal to the distal ends of each leg;

a foot extending outwardly from the distal end of each leg, the foot having four sides and an exterior wall;

a square opening centrally located within the member connected to the first and second legs, the opening separating the first leg and the second leg, the opening adapted to receive in sliding relationship the first leg or the second leg of a second member that is identical to the member;

a shoulder disposed around a portion of the opening, the shoulder acting as a stop to restrict the movement of the first leg or the second leg of the second member when it is received in the opening;

the leg slot in the first and the second leg adapted to receive at least two sides of the foot of the second member in frictional engagement along the leg slot, the leg slot enabling the foot to be frictionally engaged between approximately thirty degrees and one hundred and fifty degrees from the horizontal.

* * * * *